US007755590B2

(12) United States Patent
Park

(10) Patent No.: US 7,755,590 B2
(45) Date of Patent: Jul. 13, 2010

(54) LIQUID CRYSTAL DISPLAY DEVICE AND METHOD OF DRIVING THE SAME

(75) Inventor: Joon-Kyu Park, Seoul (KR)

(73) Assignee: LG. Display Co., Ltd., Seoul (KR)

( * ) Notice: Subject to any disclaimer, the term of this patent is extended or adjusted under 35 U.S.C. 154(b) by 795 days.

(21) Appl. No.: 10/861,300

(22) Filed: Jun. 4, 2004

(65) Prior Publication Data

US 2004/0263461 A1 Dec. 30, 2004

(30) Foreign Application Priority Data

Jun. 25, 2003 (KR) ..... 10-2003-0041341

(51) Int. Cl.
*G09G 3/36* (2006.01)

(52) U.S. Cl. ..... 345/99

(58) Field of Classification Search ..... 345/87, 345/204, 98–100

See application file for complete search history.

(56) References Cited

U.S. PATENT DOCUMENTS 5,712,652 A 1/1998 Sato et al.
5,929,831 A * 7/1999 Aratani et al. ..... 345/97
5,990,859 A * 11/1999 Inoue et al. ..... 345/103
6,417,830 B1 * 7/2002 Byeon, II ..... 345/99
6,888,522 B1 * 5/2005 Shibata et al. ..... 345/87
7,173,640 B2 * 2/2007 Mas et al. ..... 345/694
2002/0190940 A1 * 12/2002 Itoh et al. ..... 345/87
2002/0196243 A1 * 12/2002 Morita ..... 345/204

FOREIGN PATENT DOCUMENTS

JP 08-286170 11/1996
KR 2001-0082791 8/2001

* cited by examiner

*Primary Examiner*—Amr Awad
*Assistant Examiner*—Stephen G Sherman
(74) *Attorney, Agent, or Firm*—Brinks Hofer Gilson & Lione

(57) ABSTRACT

A liquid crystal display device includes a liquid crystal panel having a plurality of gate lines, a plurality of data lines, a liquid crystal element and a memory element. A mode conversion unit converts a mode of the liquid crystal panel to a normal mode or a power saving mode. A timing controller drives the liquid crystal panel in either mode and outputs gate driving information and image data. A data driver transmits the image data from the timing controller to the plurality of data lines. A gate driver decodes the gate driving information input from the timing controller to generate a gate driving signal and outputs the gate driving signal to the plurality of gate lines.

27 Claims, 6 Drawing Sheets

| input | | output | | | |
|---|---|---|---|---|---|
| A1 | A0 | Y3 | Y2 | Y1 | Y0 |
| 0 | 0 | 0 | 0 | 0 | 1 |
| 0 | 1 | 0 | 0 | 1 | 0 |
| 1 | 0 | 0 | 1 | 0 | 0 |
| 1 | 1 | 1 | 0 | 0 | 0 |

*FIG. 4*

LIQUID CRYSTAL DISPLAY DEVICE AND METHOD OF DRIVING THE SAME

This application claims the benefit of Korean Patent Application No. 2003-41341, filed on Jun. 25, 2003, which is hereby incorporated by reference.

BACKGROUND OF THE INVENTION

1. Field of the Invention

The present invention relates to a liquid crystal display device, and more particularly, to a driving circuit for a liquid crystal display device and a method of driving a liquid crystal display device.

2. Discussion of the Related Art

Recently, small-sized liquid crystal displays (LCDs) have been widely used for a small display system such as a cellular phone and a portable information tool. The small-sized LCDs should have high efficiency and low power consumption dependent on its purpose and structure. Otherwise, the operation time of the portable tool having the small-sized LCD is reduced when the small-sized LCD is driven in a full-color mode. A method of driving a small-sized LCD for reducing power consumption is suggested in U.S. Pat. No. 5,712,652.

FIG. 1 is a schematic view showing a pixel region of a small-sized liquid crystal display device according to an embodiment of the related art and FIG. 2 is a schematic view showing a pixel region of a small-sized liquid crystal display device according to another embodiment of the related art. In a small-sized LCD device of FIGS. 1 and 2, a static image of black-and-white is displayed for a predetermined time period to reduce power consumption and a moving image of full color is displayed for the other time period.

In FIG. 1, a pixel region 1 includes a liquid crystal element 4 transmitting light and a memory element 5 storing a static image data. A moving image data is output from a data driver (not shown) and supplied to the liquid crystal element 4 through a data line 3. In addition, a static image data is output from a memory driver (not shown) and supplied to the memory element 5 through a memory line 2. For example, a static random access memory (SRAM) may be formed in the memory element 5. Accordingly, two separate lines of the memory line 2 and the data line 3 and two separate drivers of the memory driver and the data driver are required. A gate signal is output from a gate driver (not shown) and supplied to the liquid crystal element 4 through a gate line 6. A control signal is output from a system control circuit (not shown) and supplied to the memory element 5 through a control line 7.

In FIG. 2, a pixel region 1 includes a liquid crystal element 4 transmitting light and a memory element 5 storing a static image data and two drivers are connected to a data line 3 using two switches. A data driver (not shown) is connected to the data line 3 through a first switch 9 and a memory driver (not shown) is connected to the data line 3 through a second switch 8. Accordingly, static image data or moving image data is supplied to the pixel region 1 by the first and second switches 9 and 8. When a moving image of full color is displayed, the first switch 9 is turned on and the second switch 8 is turned off. As a result, the moving image data output from the data driver is supplied to the liquid crystal element 4 through the data line 3. When a static image of black-and-white is displayed, the first switch 9 is turned off and the second switch 8 is turned on. As a result, the static image data output from the memory driver is supplied to the memory element 5 through the data line 3.

In the small-sized LCD device, since the static image data of a previous frame is stored in the memory element, the static image may be displayed without a gate signal and moving image data of the present frame. Accordingly, power consumption of the small-sized LCD device is reduced. However, the method of driving a small-sized LCD device displays a static image only; it is not able to display of images having few changes such as simple text for clocks or e-mail by a sequential driving method, where gate signals are sequentially input and new data is input to a liquid crystal panel for each frame.

SUMMARY OF THE INVENTION

Accordingly, the present invention is directed to a liquid crystal display device and a method of driving the same that substantially obviates one or more of the problems due to limitations and disadvantages of the related art.

An advantage of the present invention is to provide a method of driving a liquid crystal display device where power consumption is decreased.

Another advantage of the present invention is to provide a driving circuit of a liquid crystal display device having decreased power consumption.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display device includes: a liquid crystal panel having a plurality of gate lines, a plurality of data lines, a liquid crystal element and a memory element; a mode conversion unit converting a mode of the liquid crystal panel; a timing controller driving the liquid crystal panel in one of a normal mode and a power saving mode, the timing controller outputting gate driving information and image data; a data driver transmitting the image data from the timing controller to the plurality of data lines; and a gate driver decoding the gate driving information input from the timing controller to generate a gate driving signal and outputting the gate driving signal to the plurality of gate lines.

In another aspect, a method of driving a liquid crystal display device in a power saving mode includes: converting a mode of the liquid crystal display device into the power saving mode by a mode conversion unit; storing $N^{th}$ frame image data in a timing controller connected to the mode conversion unit; comparing the $N^{th}$ frame image data with $(N+1)^{th}$ frame image data to generate changed image data and gate driving information corresponding to the changed image data by the timing controller; transmitting the changed image data to a data driver connected to the timing controller; transmitting the gate driving information to a gate driver connected to the timing controller; decoding the gate driving information to supply a gate driving signal to a gate line connected to the gate driver; and supplying the changed image data to a data line connected to the data driver.

In another aspect, a method of driving a liquid crystal display device in a normal mode includes: converting a mode of the liquid crystal display device into the normal mode by a mode conversion unit; storing a frame image data in a timing controller connected to the mode conversion unit; transmitting the frame image data to a data driver connected to the timing controller; transmitting gate driving information corresponding to the frame image data to a gate driver connected to the timing controller; decoding the gate driving information to supply a gate driving signal to a gate line connected to the gate driver; and supplying the frame image data to a data line connected to the data driver.

In another aspect, a method of driving a liquid crystal display device having a plurality of gate lines and a plurality of data lines includes: converting a mode of the liquid crystal display device into a normal mode by a mode conversion unit; storing $(N-1)^{th}$ frame image data in a timing controller connected to the mode conversion unit; transmitting the $(N-1)^{th}$ frame image data to a data driver connected to the timing controller; transmitting first gate driving information corresponding to the $(N-1)^{th}$ frame image data to a gate driver connected to the timing controller; decoding the first gate driving information to supply a first gate driving signal to the plurality of gate lines connected to the gate driver; supplying the $(N-1)^{th}$ frame image data to the plurality of data lines connected to the data driver; converting the normal mode into a power saving mode by the mode conversion unit; storing $N^{th}$ frame image data in the timing controller; comparing the $N^{th}$ frame image data with $(N+1)^{th}$ frame image data to generate changed image data and second gate driving information corresponding to the changed image data by the timing controller; transmitting the changed image data to the data driver; transmitting the second gate driving information to the gate driver; decoding the second gate driving information to supply a second gate driving signal to the plurality of gate lines; and supplying the changed image data to the plurality of data lines.

In another aspect, a method of driving a liquid crystal display device having a plurality of gate lines and a plurality of data lines, a power saving mode and a normal mode, the method includes: switching into the power saving mode; in the power saving mode: comparing image data of a particular frame with image data of a different frame; generating changed image data and gate driving information corresponding to the changed image data; decoding the gate driving information to supply a gate driving signal to the gate lines; and supplying substantially the changed image data to the data lines.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 4 is a table showing inputs and outputs of a decoder circuit for a liquid crystal display device according to an embodiment of the present invention;

DETAILED DESCRIPTION OF THE ILLUSTRATED EMBODIMENTS

Reference will now be made in detail to embodiments of the present invention, example of which is illustrated in the accompanying drawings. Wherever possible, similar reference numbers will be used throughout the drawings to refer to the same or like parts.

Figure 1:
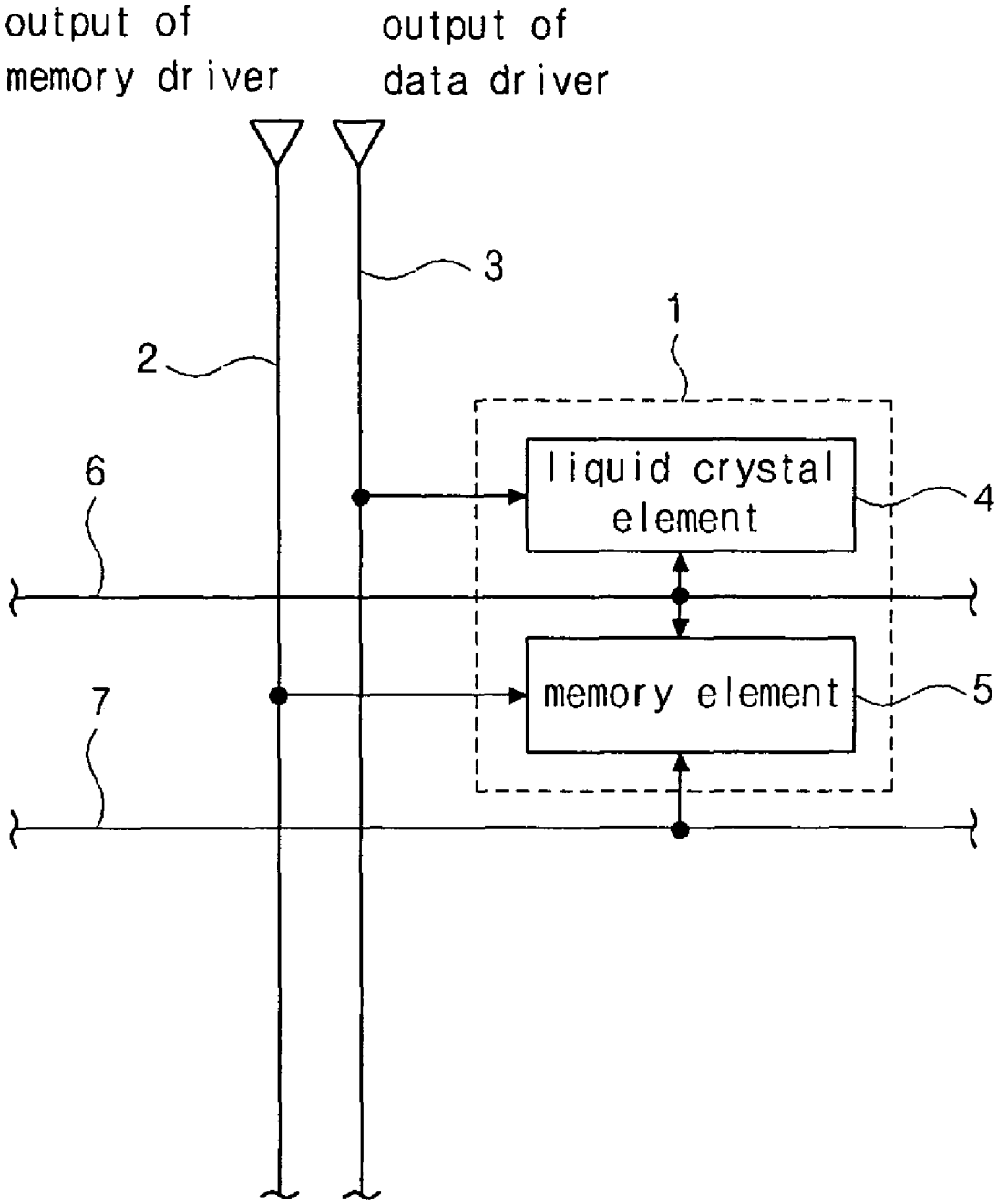
(related art) FIG. 1
FIG. 1 is a schematic view showing a pixel region of a small-sized liquid crystal display device according to an embodiment of the related art.
Figure 2:
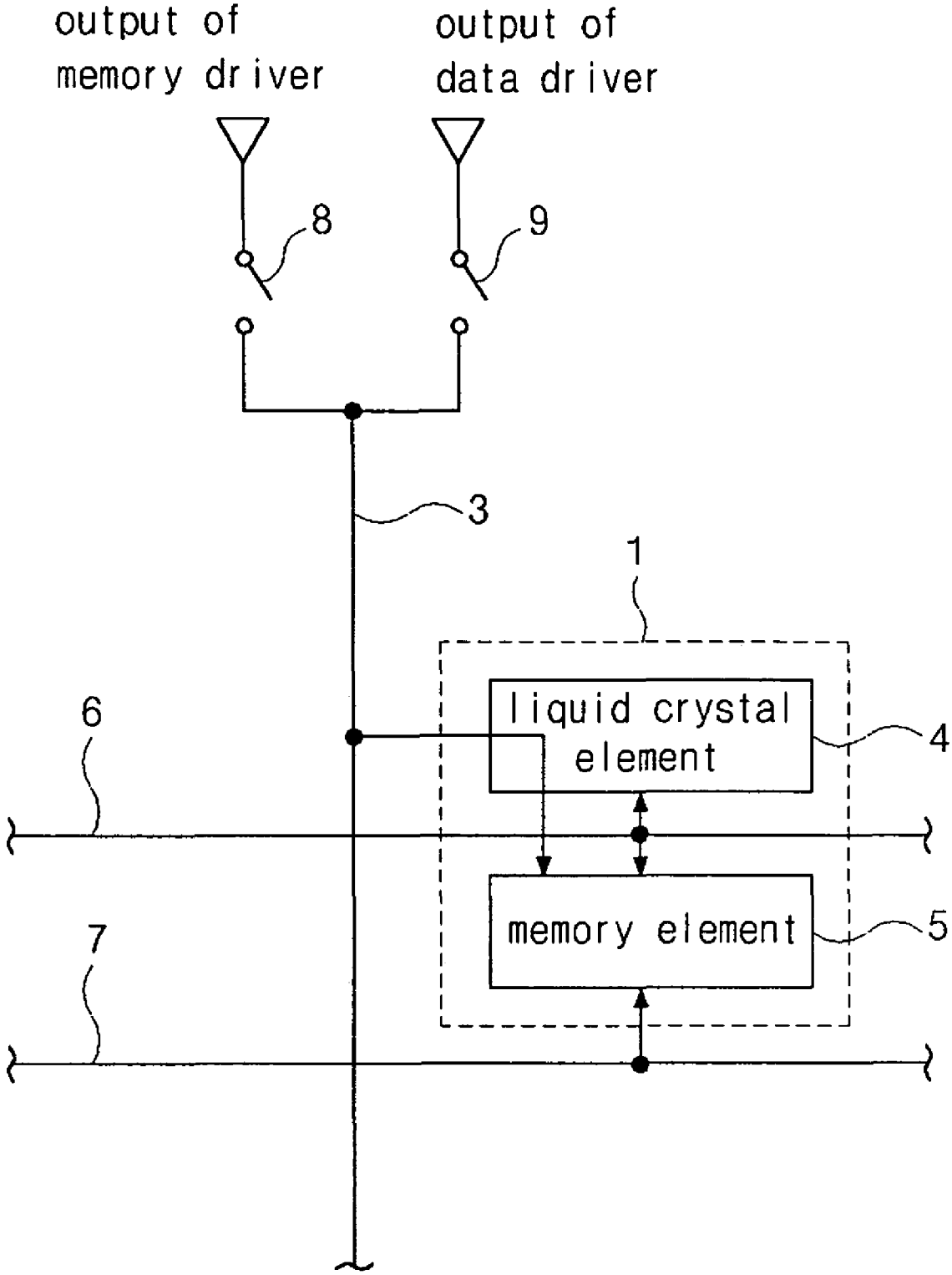
(related art) FIG. 2
FIG. 2 is a schematic view showing a pixel region of a small-sized liquid crystal display device according to another embodiment of the related art.
Figure 3:
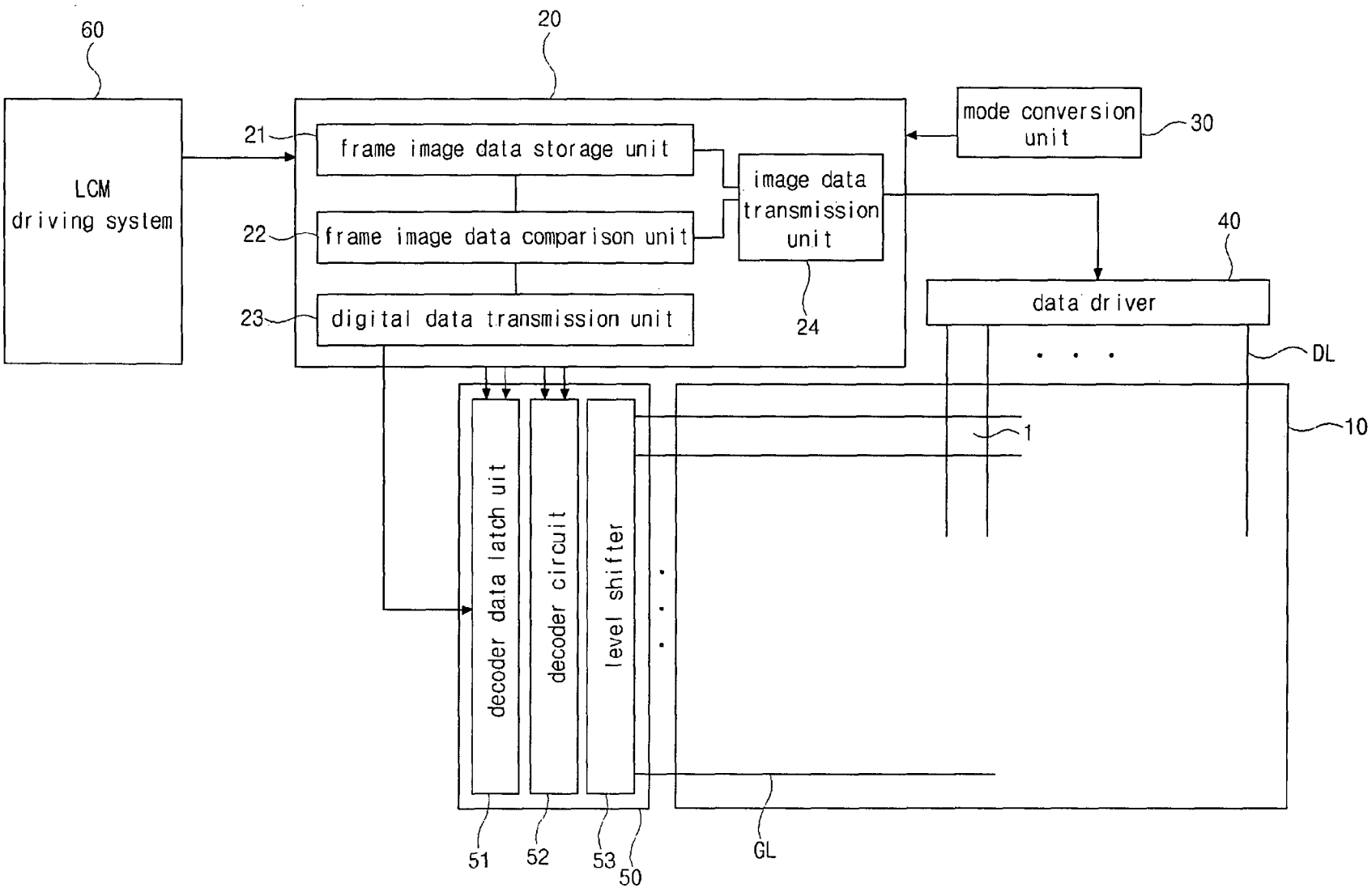
FIG. 3 is a schematic view showing a liquid crystal display device according to an embodiment of the present invention.

FIG. 3 is a schematic view showing a liquid crystal display device according to an embodiment of the present invention.

In FIG. 3, a liquid crystal display (LCD) device includes a liquid crystal panel 10, a timing controller 20, a mode conversion unit 30, a data driver 40, a gate driver 50 and a liquid crystal module (LCM) driving system 60. The liquid crystal panel 10 includes a gate line "GL" and a data line "DL" that cross each other to define a pixel region 1. The gate line "GL" and the data line "DL" are connected to the gate driver 50 and the data driver 40, respectively. A frame image data, a sync signal, a clock signal and a data enable (DE) signal are output from the LCM driving system 60 and input to the timing controller 20. The image data and a driving signal for driving the liquid crystal panel 10 are output from the timing controller 20.

The mode conversion unit 30 converts a normal mode into a power saving mode. The mode conversion unit 30 may be a switch. The power saving mode may be used for images having few changes such as the simple text of a clock or e-mail. The timing controller 20 drives the liquid crystal panel 10 differently dependent on the mode conversion unit 30. For example, the mode conversion unit 30 may output a mode signal to the timing controller 20 and the timing controller 20 may drive the liquid crystal panel 10 differently according to the mode signal. Data are input to every pixel region of the liquid crystal panel 10 in the normal mode, while data are input to some pixel regions having changes between frames in the power saving mode. The timing controller 20 includes a frame image data storage unit 21, a frame image data comparison unit 22, a digital data transmission unit 23 and an image data transmission unit 24. The frame image data output from the LCM driving system 60 is stored in the frame image data storage unit 21. The frame image data comparison unit 22 compares the stored frame image data with the next frame image data and detects changed frame image data in the power saving mode. The digital data transmission unit 23 outputs digital data to the gate driver 50 and the image transmission unit 24 outputs image data to the data driver 40. When the LCD device is driven in the normal mode, the frame image data comparison unit 22 does not operate.

The image data output from the timing controller 20 is input to the data driver 40 and supplied to the pixel region I of the liquid crystal panel 10 through the data line "DL." The gate driver 50 includes a decoder data latch unit 51, a decoder circuit 52 and a level shifter 53. The digital data output from the digital data transmission unit 23 is input to and stored in the decoder data latch unit 51. The decoder circuit 52 decodes using the digital data stored in the decoder data latch unit 51 to select a gate line "GL." A selection signal is output from the decoder circuit 52 and converted into a gate driving signal by the level shifter 53. The gate driving signal output from the level shifter 53 is supplied to the pixel region 1 of the liquid crystal panel 10 through the gate line "GL." In addition, the decoder data latch unit 51 and the decoder circuit 52 may be controlled by clock signals and driving signals output from the timing controller 20.

FIG. 4 is a table showing inputs and outputs of a decoder circuit for a liquid crystal display device according to an embodiment of the present invention.

In FIG. 4, when 2-bit digital data (A1A0) is input to a decoder circuit 52 (of FIG. 3), a four-way selection signal (Y3Y2Y1Y0) may be output from the decoder circuit 52 (of FIG. 3). Accordingly, one gate line may be selected among four gate lines. Similarly, when M-bit digital data is input to the decoder circuit, a selection signal may have $2^M$ kinds and one gate line may be selected among $2^M$ gate lines. Thus, one gate line "GL" (of FIG. 3) may be selected using digital data output from a timing controller 20 (of FIG. 3). In addition, as the number of bits of the digital data increases, total number of the gate lines controlled by the digital data increases.

According to the above decoding principle, a gate line "GL" (of FIG. 3) is selected for driving and a selection signal is output from the decoder circuit 52 (of FIG. 3). The selection signal output from the decoder circuit 52 (of FIG. 3) is converted into a gate driving signal through a level shifter 53 (of FIG. 3) and then input to a gate line "GL" (of FIG. 3) of a liquid crystal panel 10 (of FIG. 3). Moreover, the decoder data latch unit 51 (of FIG. 3) and the decoder circuit 52 (of FIG. 3) may be controlled by clock signals and driving signals output from the timing controller 20 (of FIG. 3).

Figure 5:
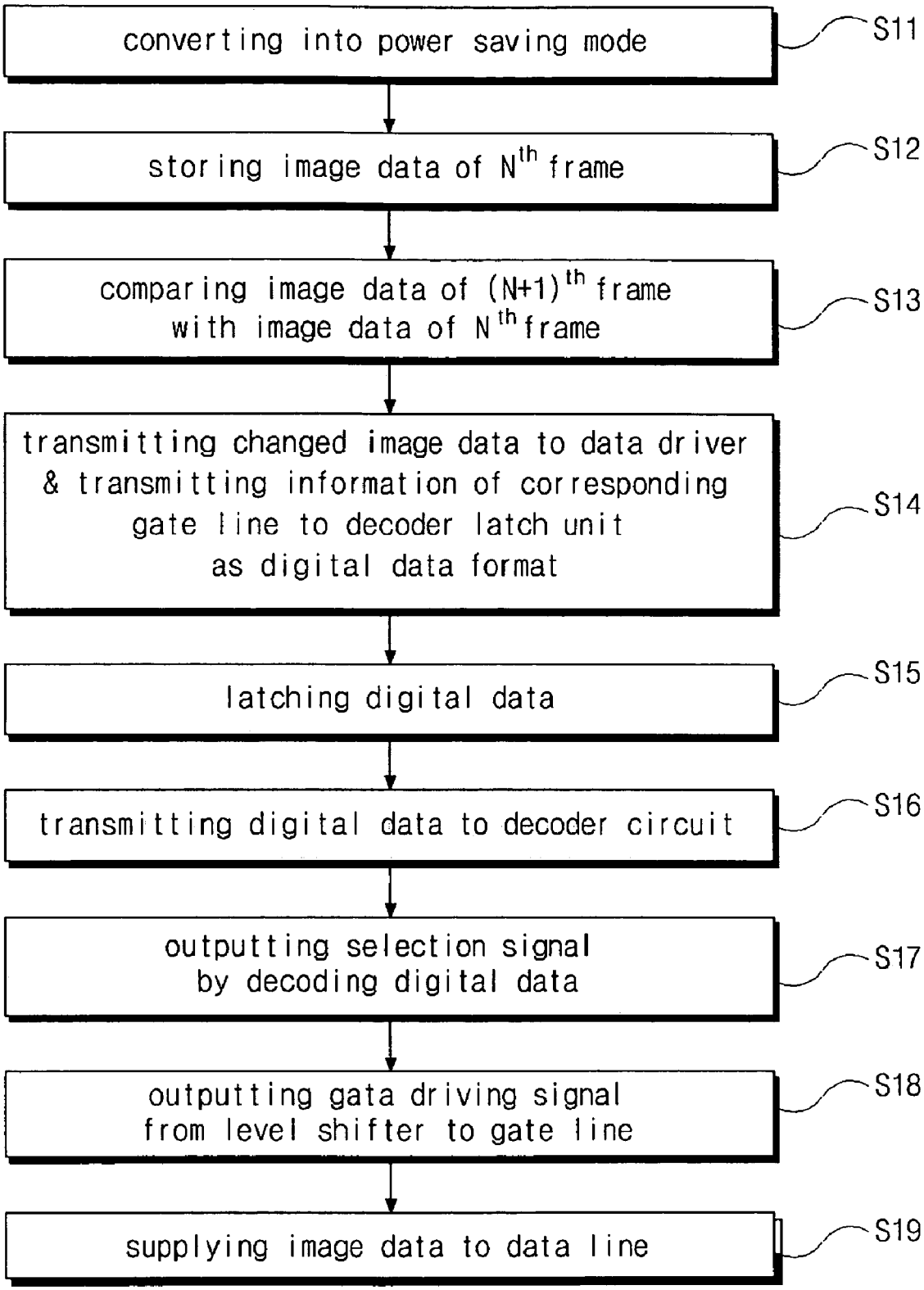
FIG. 5 is a flow chart illustrating a power saving mode operation of a liquid crystal display device according to an embodiment of the present invention.

FIG. 5 is a flow chart illustrating a power saving mode operation of a liquid crystal display device according to an embodiment of the present invention.

At step S11, a normal mode of a liquid crystal display device is converted into a power saving mode using a mode conversion unit 30 (of FIG. 3).

At step S12, image data among signals input from an LCM driving system 60 (of FIG. 3) to a timing controller 20 (of FIG. 3) may be stored in a frame data storage unit 21 (of FIG. 3) for each frame. For example, the image data of the $N^{th}$ frame may be stored in the frame data storage unit 21.

At step S13, image data of the $(N+1)^{th}$ frame input from the LCM driving system 60 (of FIG. 3) is compared with the image data of the $N^{th}$ frame stored in the frame data storage unit 21 (of FIG. 3) by a frame image data comparison unit 22 (of FIG. 3) to recognize changes of the image data. Accordingly, information of changes such as changed image data and the corresponding gate line is obtained. When there are no changes between the image data of the $N^{th}$ frame and the image data of the $(N+1)^{th}$ frame, the pixel region 1 (of FIG. 3) keeps the image data of the previous frame using the memory element.

At step S14, the information of changes is transmitted to a data driver 40 (of FIG. 3) and a gate driver 50 (of FIG. 3). For example, information of the gate line corresponding to the changed image data of the $(N+1)^{th}$ frame may be serially transmitted to a decoder data latch unit 51 (of FIG. 3) through the digital data transmission unit 23 (of FIG. 3) as an M-bit digital data format. In addition, the changed image data of the $(N+1)^{th}$ frame may be transmitted to the data driver 40 (of FIG. 3) through an image data transmission unit 24 (of FIG. 3).

At step S15, the digital data latch unit 51 (of FIG. 3) latches the digital data input from the digital data transmission unit 23 (of FIG. 3).

At step S16, the digital data latch unit 51 (of FIG. 3) transmits the digital data to a decoder circuit 52 according to a latch output enable signal of the timing controller 20 (of FIG. 3).

At step S17, the decoder circuit 52 (of FIG. 3) decodes the M-bit digital data and then outputs a selection signal according to a decoder output enable signal of the timing controller 20 (of FIG. 3).

At step S18, the selection signal is converted into a gate driving signal by a level shifter 53 (of FIG. 3) and the gate driving signal is supplied to a gate line "GL" (of FIG. 3).

At step S19, the changed image data of the $(N+1)^{th}$ frame is supplied to a data line "DL" (of FIG. 3) by the data driver 40 (of FIG. 3).

Figure 6:
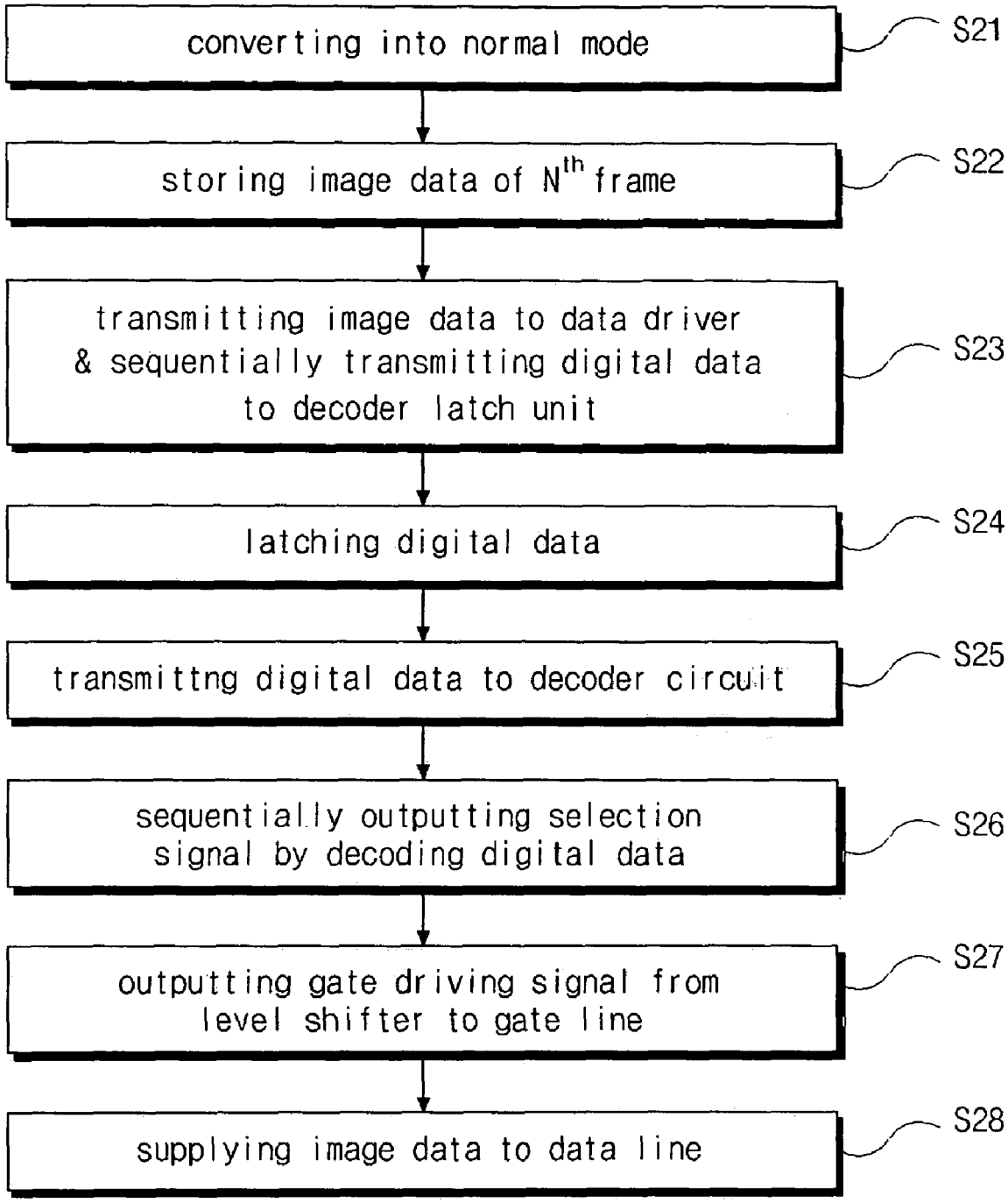
FIG. 6 is a flow chart illustrating a normal mode operation of a liquid crystal display device according to an embodiment of the present invention.

FIG. 6 is a flow chart illustrating a normal mode operation of a liquid crystal display device according to an embodiment of the present invention.

At step S21, a power saving mode of a liquid crystal display device is converted into a normal mode using a mode conversion unit 30 (of FIG. 3).

At step S22, image data among signals input from an LCM driving system 60 (of FIG. 3) to a timing controller 20 (of FIG. 3) may be stored in a frame data storage unit 21 (of FIG. 3) by frame. For example, the image data of the $N^{th}$ frame may be stored in the frame data storage unit 21.

At step S23, the image data stored in the frame data storage unit 21 is transmitted to a data driver 40 (of FIG. 3) through an image data transmission unit 24 (of FIG. 3). In order to input all of the image data of the $N^{th}$ frame to a liquid crystal panel 10 (of FIG. 3), the digital data transmission unit 23 (of FIG. 3) may serially transmit M-bit digital data to a decoder data latch unit 51 (of FIG. 3). Gate lines "GL" (of FIG. 3) may be sequentially selected according to the M-bit digital data.

At step S24, the digital data latch unit 51 (of FIG. 3) latches the digital data input from the digital data transmission unit 23 (of FIG. 3).

At step S25, the digital data latch unit 51 (of FIG. 3) transmits the digital data to a decoder circuit 52 according to a latch output enable signal of the timing controller 20 (of FIG. 3).

At step S26, the decoder circuit 52 (of FIG. 3) decodes the M-bit digital data and then sequentially outputs a selection signal according to a decoder output enable signal of the timing controller 20 (of FIG. 3).

At step S27, the selection signal is converted into a gate driving signal by a level shifter 53 (of FIG. 3) and the gate driving signal is sequentially supplied to a gate line "GL" (of FIG. 3).

At step S28, the image data of the $N^{th}$ frame is supplied to a data line "DL" (of FIG. 3) by the data driver 40 (of FIG. 3).

In an LCD device having a memory element according to the present invention, highly effective reduction of power consumption for a small-sized model is obtained. In other words, when an LCD device displays images having few changes such as simple text of a clock or e-mail, power consumption is reduced by inputting changed data only. Accordingly, lifetime of an LCD device is lengthened.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display device, comprising:

a liquid crystal panel having a plurality of gate lines, a plurality of data lines, a liquid crystal element and a memory element;

a mode conversion unit that converts a mode of the liquid crystal panel to a normal mode or a power saving mode;

a timing controller that drives the liquid crystal panel in the normal mode and the power saving mode, the timing controller capable of sequentially outputting M-bit digital data and outputting image data (wherein, M is an integer of 2 or more), each of the M- bit digital data for selecting corresponding one of the plurality of gate lines;

a data driver that transmits the image data from the timing controller to corresponding ones of the plurality of data lines; and a gate driver that decodes the M-bit digital data input from the timing controller to generate a gate driving signal and outputs the gate driving signal to the corresponding ones of the plurality of gate lines, wherein the timing controller compares $N^{th}$ frame image data with $(N+1)^{th}$ frame image data and outputs only changed image data, which are image data of pixel regions of the $(N+1)^{th}$ frame image data different from image data of pixel regions of the $N^{th}$ frame image data, to the data driver in the power saving mode (wherein, N is an integer of 1 or more).

2. The device according to claim 1, wherein the timing controller comprises:

a frame data storage unit that stores the $N^{th}$ frame image data in the power saving mode;

a frame image data comparison unit that compares the $N^{th}$ frame image data with the $(N+1)^{th}$ frame image data to generate the M-bit digital data and changed image data in the power saving mode;

a digital data transmission unit that transmits the M-bit digital data to the gate driver; and an image data transmission unit that transmits the changed image data to the data driver.

3. The device according to claim 2, wherein the frame image data comparison unit does not operate in the normal mode.

4. The device according to claim 1, wherein the gate driver comprises:

a decoder latch unit that stores the M-bit digital data;

a decoder circuit that decodes the M-bit digital data and outputs a selection signal; and a level shifter that converts the selection signal to the gate driving signal and supplies the gate driving signal to the corresponding ones of the plurality of gate lines.

5. The device according to claim 4, wherein the decoder data latch unit is adapted to receive a clock signal and a latch output enable signal from the timing controller.

6. The device according to claim 4, wherein the decoder circuit is adapted to receive a latch input enable signal and a decoder output enable signal from the timing controller.

7. The device according to claim 1, wherein the mode conversion unit output a mode signal to the timing controller and the timing controller drives the liquid crystal panel differently according to the mode signal.

8. The device according to claim 1, wherein the mode conversion unit converts the mode of the liquid crystal panel from the normal mode to the power saving mode prior to successive frames having fewer than a set number of changes in the image data.

9. The device according to claim 1, wherein the timing controller and the mode conversion unit are directly connected.

10. A method of driving a liquid crystal display device in a power saving mode, comprising:

converting a mode of the liquid crystal display device into the power saving mode;

storing $N^{th}$ frame image data (wherein, N is an integer of 1 or more);

comparing the $N^{th}$ frame image data with $(N+1)^{th}$ frame image data in a timing controller to generate changed image data, which are image data of pixel regions of the $(N+1)^{th}$ frame image data different from image data of pixel regions of the $N^{th}$ frame image data, and M-bit digital data corresponding to the changed image data (wherein, M is an integer of 2 or more);

transmitting only the changed image data to a data driver from the timing controller;

sequentially transmitting the M-bit digital data to a gate driver, each of the M-bit digital data for selecting corresponding gate line;

decoding the M-bit digital data to supply a gate driving signal to corresponding gate lines; and supplying the changed image data to corresponding data lines.

11. The method according to claim 9, wherein the M-bit digital data is decoded to output a selection signal and the selection signal is converted into the gate driving signal.

12. A method of driving a liquid crystal display device having a plurality of gate lines and a plurality of data lines, comprising:

converting a mode of the liquid crystal display device into a normal mode;

storing $(N-1)^{th}$ frame image data (wherein, N is an integer of 2 or more);

decoding first M-bit digital data to supply a first gate driving signal to the plurality of gate lines (wherein, M is an integer of 2 or more);

supplying the $(N-1)^{th}$ frame image data to the plurality of data lines;

converting the normal mode into a power saving mode;

storing $N^{th}$ frame image data;

comparing the $N^{th}$ frame image data with $(N+1)^{th}$ frame image data in a timing controller to generate changed image data, which are image data of pixel regions of the $(N+1)^{th}$ frame image data different from image data of pixel regions of the $N^{th}$ frame image data, and second M-bit digital data corresponding to the changed image data, each of the second M-bit digital data for selecting corresponding one of the plurality of gate lines;

transmitting only the changed data to a data driver from the timing controller;

decoding the second M-bit digital data to supply a second gate driving signal to the corresponding ones of the plurality of gate lines; and supplying the changed image data to corresponding ones of the plurality of data lines.

13. The method according to claim 12, wherein the first gate driving signal is sequentially supplied to the plurality of gate lines.

14. The method according to claim 12, further comprising, in the normal mode, supplying the image data to the data lines of a particular frame without comparing the image data of the particular frame with the image data of a successive frame.

15. The method according to claim 12, further comprising converting the mode of the liquid crystal panel from the normal mode to the power saving mode prior to successive frames having fewer than a set number of changes in the image data.

16. The method according to claim 12, further comprising operating the liquid crystal display device in the power saving mode when the liquid crystal display device displays a clock or e-mail.

17. A method of driving a liquid crystal display device having a plurality of gate lines and a plurality of data lines, a power saving mode and a normal mode, the method comprising:

switching into the power saving mode;

in the power saving mode:

comparing image data of a particular frame with image data of a different frame after the particular frame in a timing controller;

generating changed image data in the timing controller, which are data of the image data of pixel regions of the different frame different from data of the image data of pixel regions of the particular frame, and M-bit digital data corresponding to the changed image data (wherein, M is an integer of 2 or more), each of the M-bit digital data for selecting corresponding one of the plurality of gate lines;

transmitting only the changed image data to a data driver from the timing controller;

decoding the M-bit digital data to supply a gate driving signal to the gate lines; and supplying substantially the changed image data to corresponding ones of the plurality of data lines.

18. The method according to claim 17, further comprising sequentially supplying the gate driving signal to the plurality of gate lines in a normal mode of the liquid crystal display device.

19. The method according to claim 17, further comprising switching directly into the power saving mode from the normal mode.

20. The method according to claim 17, further comprising, in the normal mode, supplying the image data to the data lines of a particular frame without comparing the image data of the particular frame with the image data of a different frame.

21. The method according to claim 17, further comprising switching into the power saving mode prior to successive frames having fewer than a set number of changes in the image data.

22. The method according to claim 17, further comprising addressing a predetermined fraction of the plurality of data or gate lines during one frame in the power saving mode.

23. The method according to claim 17, further comprising operating the liquid crystal display device in the power saving mode when the liquid crystal display device displays a clock or e-mail.

24. The method according to claim 17, further comprising storing the image data in both the normal mode and the power saving mode.

25. The method according to claim 24, wherein the image data stored is the image data of the frame to be displayed.

26. The method according to claim 24, wherein the image data stored is the image data of the frame to be displayed in the normal mode and the image data of the previous frame displayed in the power saving mode.

27. The method according to claim 17, further comprising generating the M-bit digital data in both the normal mode and the power saving mode.

* * * * *